US005291736A

United States Patent [19]

Paradowski

[11] Patent Number: 5,291,736

[45] Date of Patent: Mar. 8, 1994

[54] METHOD OF LIQUEFACTION OF NATURAL GAS

[75] Inventor: Henri Paradowski, Cergy Pontoise, France

[73] Assignee: Compagnie Francaise D'Etudes et de Construction "Technip", France

[21] Appl. No.: 954,318

[22] Filed: Sep. 30, 1992

[30] Foreign Application Priority Data

Sep. 30, 1991 [FR] France ..... 91 12007

[51] Int. Cl.[5] ..... F25J 3/00

[52] U.S. Cl. ..... 62/20; 62/28; 62/40

[58] Field of Search ..... 62/20, 23, 28, 40

[56] References Cited

U.S. PATENT DOCUMENTS

| | | | |
|---|---|---|---|
| 3,763,658 | 10/1973 | Gaumer, Jr. et al. | 62/40 |
| 3,945,214 | 3/1976 | Darredeau et al. | 62/54 |
| 4,065,278 | 12/1977 | Newton et al. | 62/26 |
| 4,140,504 | 2/1979 | Campbell et al. | 62/38 |
| 4,155,729 | 5/1979 | Gray et al. | 62/23 |
| 4,185,978 | 1/1980 | McGalliard et al. | 62/28 |
| 4,203,741 | 5/1980 | Bellinger et al. | 62/24 |
| 4,203,742 | 5/1980 | Agnihorti | 62/23 |
| 4,251,247 | 2/1981 | Gauberthier et al. | 62/9 |
| 4,274,849 | 6/1981 | Garier et al. | 62/9 |
| 4,339,253 | 7/1982 | Caetani et al. | 62/40 |
| 4,539,028 | 9/1985 | Paradowski et al. | 62/9 |
| 4,657,571 | 4/1987 | Gazzi | 62/17 |
| 4,707,170 | 11/1987 | Ayres et al. | 62/40 |

FOREIGN PATENT DOCUMENTS

| | | |
|---|---|---|
| 0178207 | 4/1986 | European Pat. Off. . |
| 2128674 | 10/1972 | France . |

*Primary Examiner*—Ronald C. Capossela
*Attorney, Agent, or Firm*—Steinberg & Raskin

[57] ABSTRACT

A method of liquefying natural gas, wherein the gas (1) is cooled and separated into a liquid phase (6) and a gaseous phase (8) which is expanded (9) and added to the liquid phase in the column (7), at the head of which the gas enriched with methane (21) is separated and recompressed (27) and carried to the liquefaction (32, 33, 34) whereas the liquid phase from the bottom of column (7) is expanded and rectified in column (14); the head effluent (19) being condensed (20) and conveyed as a reflux (25) to column (7); the pressure in column (7) being higher than that of column (14); the $C_3+$ hydrocarbons from the bottom (16) being separated and the methane liquefaction (33, 34) being conventional.

9 Claims, 1 Drawing Sheet

METHOD OF LIQUEFACTION OF NATURAL GAS

BACKGROUND OF THE INVENTION

The invention relates to a method of liquefaction of natural gas comprising the separation of hydrocarbons heavier than methane.

The natural gas and the other gaseous streams rich in methane are available generally at sites remote from the places of utilization and it is therefore usual to liquefy the natural gas in order to convey it by land carriage or by sea. The liquefaction is widely practised currently and the literature and the patents disclose many liquefaction processes and devices. The U.S. Pat. Nos. 3,945,214; 4,251,247; 4,274,849; 4,339,253 and 4,539,028 are examples of such methods.

It is also known to fractionate the streams of light hydrocarbons, for example containing methane and at least one higher hydrocarbon such as a ethane to hexane or higher through cryogenics.

Thus the U.S. Pat. No. 4,690,702 discloses a method in which the batch of hydrocarbons under high pressure ($P_1$) is cooled so as to cause the liquefaction of one portion of the hydrocarbons; one separates a gaseous phase ($G_1$) from a liquid phase ($L_1$); one expands the gaseous phase ($G_1$) to lower its pressure to a value ($P_2$) lower than ($P_1$) one carries the liquid phase ($L_1$) and the gaseous phase ($G_1$) under the pressure ($P_2$) into a first fractionating zone, for example a purification-contact refrigeration column; one draws off at the head a residual gas ($G_2$) rich in methane the pressure of which is then raised to a value ($P_3$); one draws off at the bottom a liquid phase ($L_2$) one carries the phase ($L_2$) into a second fractionating zone, for example a fractionating column; one draws off at the bottom a liquid phase ($L_3$) enriched with higher hydrocarbons, for example $C_3+$; one draws off at the head a gaseous phase ($G_3$); one condenses at least one part of the gaseous phase ($G_3$) and one carries at least one part of the resulting condensed liquid phase ($L_4$) as an additional feed to the head of the first fractionating zone. In this process the second fractionating zone operates at a pressure ($P_4$) higher than the pressure of the first fractionating zone, for example 0.5 MPa for the first zone and 0.68 MPa for the second zone.

SUMMARY OF THE INVENTION

Advantageously in the aforesaid method the expansion of $G_1$ takes place in a pressure reducing turbodevice which transmits at least one part of the recovered energy to a turbocompressor which raises the pressure of $G_2$ to the value $P_3$.

The interest in such a method is to recover with a high efficiency condensates such as $C_3$, $C_4$, gasoline, etc . . . which are valuable products.

There has already been proposed to associate a natural gas fractionating unit with a liquefaction unit so as to be able to recover both liquid methane and condensates such as $C_3$, $C_4$ and/or higher ones. Such proposals are made for example in the U.S. Pat. Nos. 3,763,658 and 4,065,278, wherein the liquefaction unit may be of a conventional type.

The difficulty to overcome in this kind of equipment is to obtain a reduced operating cost. In particular, it is unavoidable to recover the recompressed gas under a pressure ($P_3$) lower than that ($P_1$) under which it was initially unless consuming additional power. Now the further liquefaction of methane is all the more easy as its pressure is higher.

There is therefore room in the art for an economical method of fractionating hydrocarbons from natural gas and for subsequent liquefaction of methane.

The method according to the invention distinguishes in its fractionating part from the method according to U.S. Pat. No. 4,690,702 in that the pressures used in the fractionating zones are higher than those previously used and in that the second fractionating zone operates under a pressure lower than in the first fractionating zone.

According to the invention the batch of gaseous hydrocarbons containing methane and at least one hydrocarbon heavier than methane, under a pressure $P_1$, is cooled in one or several stages so as to form at least one gaseous phase $G_1$; the gaseous phase $G_1$ is expanded to lower its pressure from the value $P_1$ down to a value $P_2$ lower than $P_1$; the product of the expansion under the pressure $P_2$ is carried into a first contact fractionating zone; a residual gas $G_2$ enriched with methane is drawn off the head; a liquid phase $L_2$ is drawn off the bottom; the liquid phase $L_2$ is carried into a second zone of fractionating through distillation; at least one liquid phase $L_3$ enriched with hydrocarbons heavier than methane is drawn off the bottom; a gaseous phase $G_3$ is drawn off the head; at leats one portion of the gaseous phase $G_3$ is condensed to yield a condensed phase $L_4$ and one raises the pressure of at least one portion of the condensed phase $L_4$ which is carried to the first fractionating zone as a reflux and the residual gas $G_2$ is then more cooled down under a pressure at least equal to $P_2$ in a methane liquefaction zone so as to obtain a liquid rich in methane. According to the characterizing feature of the invention, the pressure $P_4$ in the second fractionating zone is lower than that $P_2$ of the first fractionating zone.

By way of example the gas is initially available under a pressure $P_1$ of at least 5 MPa, preferably of at least 6 MPa. During the expansion its pressure is advantageously brought to a value $P_2$ such as $P_2=0.3$ to $0.8\ P_1$, $P_2$ being chosen for example to be between 3.5 and 7 MPa, preferably between 4.5 and 6 MPa. The pressure $P_4$ in the second fractionating zone is advantageously such that $P_4=0.3$ to $0.9\ P_2$, $P_4$ having a value lying for example between 0.5 and 4.5 MPa, preferably between 2.5 and 3.5 MPa.

Several embodiments may be used:

According to a preferred embodiment the expansion of $G_1$ is carried out in one several turboexpander coupled with one or several turbocompressors which would recompress the residual gas $G_2$ from the pressure $P_2$ to a pressure $P_3$.

According to another preferred embodiment during the initial cooling of the gas, one forms at least one liquid phase $L_1$ in addition to the gaseous phase $G_1$ and one carries the liquid phase $L_1$ after expansion thereof into the said first contact fractionating zone.

According to a further alternative embodiment one fully condenses the gaseous phase $G_3$ and one carries one portion thereof to the second fractionating zone as an internal reflux and the complement to the first fractionating zone as a reflux. To achieve this result one may act upon the reboiler of the first fractionating zone so as to control the $C_1/C_2$-ratio of the liquid phase $L_3$.

If the cooling of the phase $G_3$ is not sufficient to fully condensate this phase, which is preferred, one may complete the condensation by further compressing the said phase $G_3$ with subsequent cooling thereof.

BRIEF DESCRIPTION OF THE FIGURE

The invention will be better understood and further objects, characterizing features, details and advantages thereof will appear more clearly from the following explanatory description with reference to the accompanying diagrammatic drawing given by way of non limiting example only and the single figure of which illustrates a presently preferred specific embodiment of the invention.

DETAILED DESCRIPTION OF THE INVENTION

Figure 1:
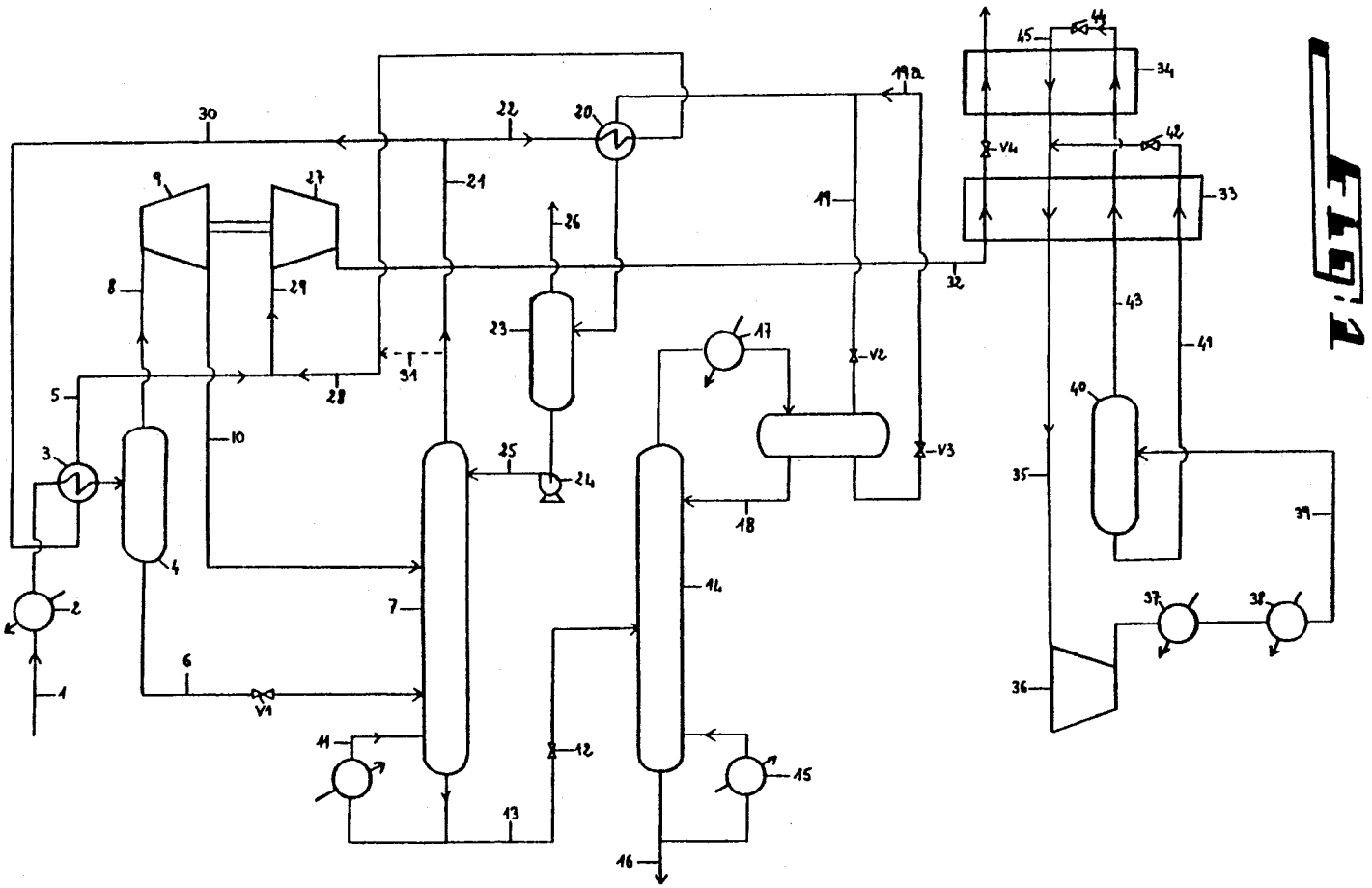

The natural gas from the pipeline 1 flows through one or several exchangers 2, for instance of the kind with propane or with a liquid $C_2/C_3$ mixture, and advantageously through one or several exchangers using cold fluids of the process. Preferably the cold fluid is coming through the pipeline 5 from the first contact column 7. The gas which here is partially liquefied in the drum 4 into a liquid carried to the column 7 by the pipeline 6 fitted with a valve $V_1$ and into a gas carried by the pipeline 8 to the turboexpander 9. The expansion causes a partial liquefaction of the gas and the product of the expansion is conveyed by the pipeline 10 to the column 7. This column is of a conventional type, for example with plates or with a packing. It comprises a reboiling circuit 11. The liquid effluent from the column bottom is expanded by the valve 12 and conveyed by the pipeline 13 to the column 14. This column which operates at a higher pressure than the column 7, has a reboiler 15. The liquid effluent, enriched with hydrocarbons higher than methane, for instance with $C_3+$, flows out through the pipeline 16. At the head the vapors are partially or fully condensed within the condenser 17. The resulting liquid phase is carried back at least in part to the column 14 as a reflux through the pipeline 18. The gaseous phase (pipeline 19 and valve $V_2$) is then condensed, preferably fully, by cooling preferably within the exchanger 20 fed with at least one portion of the residual gas from the head of the column 7 (pipelines 21 and 22).

Alternatively the valve $V_2$ is shut off if the whole vapor phase has been condensed in 17. The valve $V_3$ is opened and it is then the liquid phase which is conveyed towards the column 7 by the pipeline 19*a*. One may also open both valves $V_2$ and $V_3$ and thus convey a mixed phase.

The liquid phase resulting from the cooling within the exchanger 20 passes into the drum 23, the recompression pump 24 and returns to the column 7 through the pipeline 25 as a reflux. If the condensation in the exchanger 20 is not total, which is less preferred, the residual gas may be discharged by the pipeline 26. The residual gas issuing from the head of the column 7 through the pipeline 21 in the aforesaid embodiment passes through the exchanger 20 before being carried to the turbocompressor 27 by the pipelines 28 and 29. The turbocompressor is driven by the turboexpander 9.

According to a modification, at least one portion of the residual gas in the pipeline 21 is carried by the pipeline 30 to the exchanger 3 for cooling down the natural gas. It it then conveyed to the turbocompressor 27 by the pipelines 5 and 29.

In another alternative embodiment not shown the residual gas (pipeline 21) would successively pass into the exchangers 20 and 3 or reversely before being conveyed to the turbocompressor 27.

Further arrangements may be provided as this will be understood by those skilled in or conversant with the art, and would allow to provide for the cooling necessary to the gas in the pipelines 1 and 19. It is for instance possible to directly convey the gas from the pipeline 21 to the compressor 27 by the pipeline 31 and to differently provide for the cooling of the exchangers 3 and 20.

After having been recompressed in the turbocompressor 27, the gas is conveyed by the pipeline 32 which may comprise one or several exchangers not shown, to a conventional methane liquefaction unit shown here in a simplified manner. It flows through a first cooling exchanger 33 and then through the expansion valve $V_4$ and a second cooling exchanger 34 where the liquefaction and the sub-cooling are completed. The cold-generating or coolant circuit of conventional or improved type (one may for instance use the circuit according to the U.S. Pat. No. 4,274,849) is diagrammatically illustrated here by the use of a multicomponent fluid, for example a mixture of nitrogen, methane, ethane and propane initially in the gaseous state (pipeline 35), which is compressed by one or several compressors such as 36, cooled down by the external medium such as air or water within one or several exchangers such as 37, further cooled in the exchanger 38, for example by propane or a liquid $C_2/C_3$ mixture. The partially condensed mixture is supplied to the drum 40 by the pipeline 39. The liquid phase passes through the pipeline 41 into the exchanger 33, is expanded by the valve 42 and flows back to the pipeline 35 while flowing through the exchanger 33 where it is being reheated while cooling down the streams 32 and 41. The vapor phase from the drum 40 (pipeline 43) would flow through the exchangers 33 and 34 where it is condensed and then expanded within the valve 44 and flows through the exchangers 34 and 33 through the pipelines 45 and 35.

In summary the liquefaction of methane is performed by indirect contact with one or several fractions of a multicomponent fluid being vaporizing and circulating in a closed circuit comprising a compression, a cooling with liquefaction yielding one or several condensates and the vaporization of said condensates constituting the said multicomponent fluid.

By way of non limiting example, one treats a natural gas having the following molar percentage composition:

| | |
|---|---|
| Methane | 90.03 |
| Ethane | 5.50 |
| Propane | 2.10 |
| $C_4$-$C_6$ | 2.34 |
| Mercaptans | 0.03 |
| | 100.00 |

under a pressure of 8 MPa.

After having been cooled by liquid propane and by the effluent from the head of the column 7, the gas reaches the drum 4 at a temperature of −42° C. The liquid phase is carried by the pipeline 6 to the column 7 and the gaseous phase is expanded by the turboexpander down to 5 MPa. The liquid phase (pipeline 13) collected at the temperature of +25° C. is expanded down to 3.4 MPa in the valve 12 and then fractionated within the column 14 which receives the reflux from the pipeline 18. This column 14 has a bottom temperature of 130° C. and a head temperature of −13° C.

The residual gas issues from the column 7 at −63° C. and is directed in part towards the exchanger 3 and in part towards the exchanger 20. After having been recompressed in 27 upon using the energy from the turboexpander 9 only, the gas pressure is 5.93 MPa. This gas the temperature of which is −28° C. exhibits the following molar percentage composition:

| | |
|---|---|
| Methane | 93.90 |
| Ethane | 5.51 |
| Propane | 0.53 |
| $C_4$-$C_6$ | 0.06 |
| Mercaptans | below 10 ppm |
| | 100.00 |

This stream represents 95.88 molar percent of the stream charging the equipment.

It is found that the equipment has permitted to remove the quasi-totality of the mercaptans from the gas to be liquefied.

The liquefaction takes place as follows:

The gas is cooled and condensed down to −126° C. in a first tube stack of the heat exchanger 33 and then expanded down to 1.4 MPa and subcooled within a second tube stack of the heat exchanger 34 down to −160° C. From there it is carried to the storage.

The refrigerating fluid has the following molar composition:

| | |
|---|---|
| $N_2$ | 7% |
| Methane | 38% |
| Ethane | 41% |
| Propane | 14% |

This fluid is compressed up to 4.97 MPa, cooled down to 40° C. within a water exchanger 37 and then cooled down to −25° C. within the exchangers diagrammatically shown at 38 through indirect contact with a liquid $C_2/C_3$-mixture and then fractionated within the separator 40 to yield the liquid phase 41 and the gaseous phase 43. The gaseous phase is condensed and cooled down to −126° C. in a second tube stack of the exchanger 33 and then subcooled down to −160° C. in a tube stack of the exchanger 34. After having been expanded down to 0.34 Mpa, it is used to cool the natural gas and would return to the compressor 36 after having flown through the shell of each one of the exchangers 34 and 33 and having received the liquid stream from the pipeline 41 which has flown through the valve 42 after having been subcooled down to −126° C. in 33.

At the inlet of the compressor (pipeline 35), the pressure is 0.3 MPa and the temperature is −28° C.

By way of comparison all things beside being substantially equal, when one operates the column 7 at 3.3 MPa with a temperature of +1° C. at the bottom and −64° C. at the head and the column 14 at 3.5 MPa with a temperature of 131° C. at the bottom and −11.7° C. at the head, i.e. under conditions which are derived from the teaching of the U.S. Pat. No. 4,690,702 already cited the gas pressure at the outlet of the turbocompressor 27 reaches 5.33 MPa only and the temperature is −24° C., which is much less adavantageous for the subsequent liquefaction and would require a clearly greater power expenditure.

What is claimed is:

1. Method of liquefaction of natural gas, comprising the steps of cooling a natural gas containing methane and a hydrocarbon heavier than methane under a pressure $P_1$ so as to form at least one gaseous phase $G_1$, expanding the gaseous phase $G_1$ to lower its pressure and to bring it to a pressure $P_2$ lower than the pressure $P_1$, carrying the product of the expansion under the pressure $P_2$ into a first contact fractionating zone, drawing off residual gas $G_2$ enriched with methane from the head of the first fractionating zone, drawing off a liquid phase $L_2$ from the bottom of the first fractionating zone, conveying the liquid phase $L_2$ into a second zone for fractionating through distillation, drawing off at least one liquid phase $L_3$ enriched with hydrocarbons heavier than methane from the bottom of the second fractionating zone, drawing off a gaseous phase $G_3$ from the head of said second fractionating zone, condensing at least one part of the gaseous phase $G_3$ drawn off from the head of the second fractionating zone to produce a condensed phase $L_4$, raising the pressure of at least one portion of the condensed phase $L_4$, carrying said at least one portion of the condensed phase $L_4$ to the first fractionating zone as a reflux, cooling the residual gas $G_2$ under a pressure at least equal to the pressure $P_2$ in a methane liquefaction zone so as to obtain a liquid rich in methane, and operating the second fractionating zone under a pressure $P_4$ which is lower than the pressure $P_2$ of the first fractionating zone.

2. Method according to claim 1, further comprising the steps of effecting the expansion of the gaseous phase $G_1$ in a turboexpander, effecting an increase in the pressure of the residual gas from the pressure $P_2$ to a pressure $P_3$ in a turbocompressor and using the energy supplied by the expansion of the gaseous phase $G_1$ for actuating the turbocompressor.

3. Method according to claim 1, wherein the pressure $P_1$ is greater than about 5 MPa, the pressure $P_2$ is from about 0.3 $P_1$ with $P_2$ being between 3.5 and 7 MPa and the pressure $P_4$ from about 0.3 $P_2$ to about 0.9 $P_2$, with $P_4$ between about 0.5 and about 4.5 MPa.

4. Method according to claim 3, wherein $P_1$ is greater than about 6 MPa, $P_2$ is between 4.5 and 6 MPa and $P_4$ is between 2.5 and 3.5 MPa.

5. Method according to claim 2, further comprising directing at least one portion of the residual gas $G_2$ to exchange heat with the natural gas to thereby contribute to the cooling of the natural gas, said at least one portion of residual gas $G_2$ exchanging heat with the natural gas prior to the raising of the pressure of said residual gas $G_2$ from pressure $P_2$ to pressure $P_3$.

6. Method according to claim 1, further comprising directing at least one part of the residual gas $G_2$ to exchange heat with at least one part of the gaseous phase $G_3$ to cool the gaseous phase $G_3$ and produce the condensed phase $L_4$.

7. Method according to claim 1, further comprising conducting the liquefaction of methane through indirect contact with one or several fractions of a multicomponent fluid, said multicomponent fluid being vaporized and circulating in a closed circuit comprising a compression zone, a cooling zone with liquefaction yielding one or several condensates and a zone for the vaporization of said condensates to reconstitute said multicomponent fluid.

8. Method according to claim 1, further comprising forming at least one liquid phase $L_1$ during the initial cooling of the gas in addition to the gaseous phase $G_1$ and carrying the liquid phase $L_1$ after an expansion of the liquid phase $L_1$ into said first fractionating zone.

9. Method according to claim 1, further comprising condensing the gaseous phase $G_3$ and conveying one portion thereof to the second fractionating zone as an internal reflux and the the remaining portion to the first fractionating zone as a reflux.

* * * * *

UNITED STATES PATENT AND TRADEMARK OFFICE

CERTIFICATE OF CORRECTION

PATENT NO. : 5,291,736

DATED : March 8, 1994

INVENTOR(S) : Henri PARADOWSKI

It is certified that error appears in the above-indentified patent and that said Letters Patent is hereby corrected as shown below:

Column 2, line 27, change "leats" to --least--.

Column 3, line 33, change "higher" to --lower--.

Column 5, line 66, change "adavantageous" to --advantageous--.

Signed and Sealed this

Tenth Day of September, 1996

Bruce Lehman

*Attest:*

BRUCE LEHMAN

*Attesting Officer*

*Commissioner of Patents and Trademarks*